US006134741A

United States Patent [19]

Spalione

[11] Patent Number: 6,134,741

[45] Date of Patent: Oct. 24, 2000

[54] ABSORBENT CLEANING SLIPPERS

[76] Inventor: Gaile R. Spalione, 25513 Fitzgerald Ave., Stevenson Ranch, Calif. 91381

[21] Appl. No.: 09/190,482

[22] Filed: Nov. 12, 1998

Related U.S. Application Data

[60] Provisional application No. 60/066,451, Nov. 24, 1997.

[51] Int. Cl.[7] ..... A47L 13/20; A47L 13/282

[52] U.S. Cl. ..... 15/227; 36/100; 36/136

[58] Field of Search ..... 15/227, 209.1, 15/210.1; 36/15, 9 R, 136, 100, 101, 61, 62, 7.1 R, 132; 134/6

[56] References Cited

U.S. PATENT DOCUMENTS

| | | |
|---|---|---|
| 1,915,333 | 6/1933 | Rosenblum . |
| 2,571,606 | 10/1951 | Peterson . |
| 2,738,533 | 3/1956 | Peterson . |
| 2,784,436 | 3/1957 | Peterson . |
| 2,839,845 | 6/1958 | Burton . |
| 3,460,182 | 8/1969 | Grande . |
| 3,680,170 | 8/1972 | Sims . |
| 3,699,672 | 10/1972 | Sims . |
| 4,811,444 | 3/1989 | Hamblin . |
| 4,896,439 | 1/1990 | Morgan . |
| 4,924,608 | 5/1990 | Mogonye . |
| 5,173,985 | 12/1992 | Palmer . |
| 5,613,897 | 3/1997 | Thompson . |
| 5,644,813 | 7/1997 | Puskas . |
| 5,943,792 | 8/1999 | Powell . |
| 6,047,434 | 4/2000 | Falwell . |
| 6,052,856 | 4/2000 | DeMoya et al. . |

*Primary Examiner*—Deborah Jones
*Assistant Examiner*—Jennifer McNeil
*Attorney, Agent, or Firm*—Allan M. Shapiro

[57] ABSTRACT

A pair of slippers has a moisture-transmitting band across the bottom. An absorbent sponge is placed within the band and the band is secured by a hook and loop fastener. The slipper is worn in this condition when the sponge exchanges water to and from the floor to clean the floor and pick up spills. The securing band is releasable to change the absorbent material. In one embodiment the securing band is detachable for separate washing. Spills may be picked up without bending over.

12 Claims, 2 Drawing Sheets

ABSORBENT CLEANING SLIPPERS

CROSS REFERENCE

This application refers to Provisional Application Ser. No. 60/066,451 of Nov. 24, 1997 for priority.

FIELD OF THE INVENTION

This invention is directed to slippers to be worn on the feet, the slippers having absorbent material on the bottom to permit the cleaning of floors and maintain the cleanliness of floors while wearing the slippers.

BACKGROUND OF THE INVENTION

Floors get dirty by having materials brought in from the outside or by spilling or dropping materials on the floor. Most commonly, food materials are dropped in the kitchen and in the dining room. Quite often, the dropping of materials comprises the spilling of liquids. Presently, the common method for cleaning floors is to use a mop. A mop is a stick of convenient length with a sponge, cloth or cotton strings attached to it. The material attached to the mop handle is always absorbent. The user brings the mop to the spill, where the spill is absorbed.

The absorbent mop is also used in the cleaning of floors. In such a case, soapy water is deposited on the floor, often by wetting the mop. The mop is moved around the floor to distribute the soapy water and rub on dirt spots. The mop is rinsed and squeezed and then used to pick up the water on the floor. This method works with sponge or string mops. Such a mopping system is usually put away when mopping is done. The mop bucket is poured out and the mop dries in a closet. A mop of that nature is difficult to bring into use for a small spill.

SUMMARY OF THE INVENTION

In order to aid in the understanding of this invention, it can be stated in essentially summary form as it is directed to absorbent cleaning slippers. The slippers have uppers of any convenient, flexible material that are preferably washable and thus preferably are made of leather material, leather-like material or of fabric. The slippers have a water-proof sole beneath the feet. Attached to the bottom of the sole is a band of water-transmissive material, such as cotton terry cloth. The band is secured to one side of the slipper and is detachably secured on the other side by means of hook and loop fastener. Thus, absorbent material such as sponges, towels or pads can be detachably attached under the sole and held in place by the band. The slippers are worn on the feet and pick up spilled liquids as the wearer moves them over the floor.

It is thus a purpose and advantage of this invention to provide absorbent cleaning slippers which can be worn in the kitchen and dining room to pick up spilled liquids as well as polish and dry the floor.

It is another purpose and advantage of the invention to provide absorbent cleaning slippers wherein absorbent cleaning aids such as sponges, towels or pads can be held to the bottom of the sole by means of a band which wraps around them and holds the cleaning aids against the sole.

It is a further purpose and advantage of the invention to provide absorbent cleaning slippers which are comfortable to wear, protect the foot against moisture and are inexpensive so that they can be regularly used.

The features of the present invention which are believed to be novel are set forth with particularity in the appended claims. The present invention, both as to its organization and manner of operation, together with further purposes and advantages thereof, may be understood best by reference to the following description, taken in conjunction with the accompanying drawings.

DESCRIPTION OF THE PREFERRED EMBODIMENT

Figure 1:
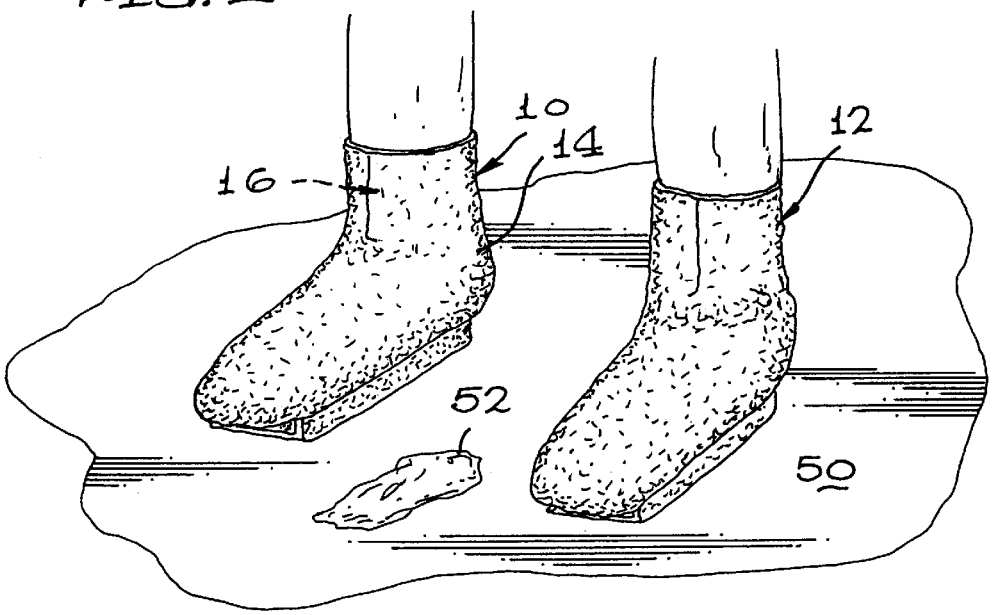
FIG. 1 is a perspective view of a pair of absorbent cleaning slippers in accordance with this invention, as worn by the user.
Figure 3:
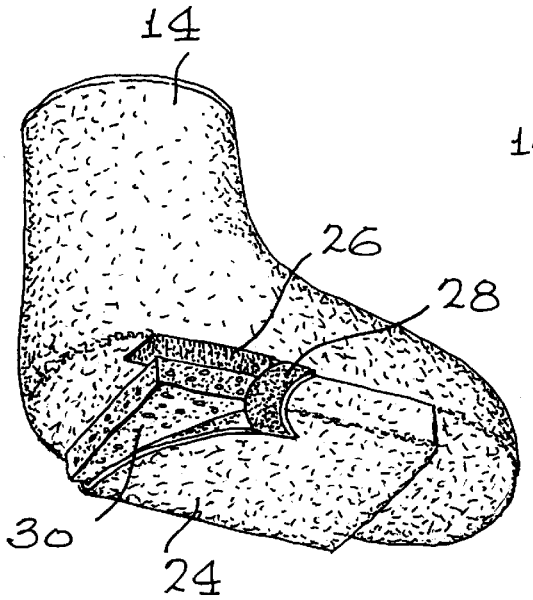
FIG. 3 is an enlarged front view of the right slipper, with parts broken away and parts taken in section.

A pair of absorbent cleaning slippers in accordance with this invention is shown in FIG. 1. The pair comprises right slipper 10 and left slipper 12. The slippers 10 and 12 are symetrically identical and only the right slipper 10 is shown in and described with the following figures. The left slipper 12 has the same features. The upper 14 of the slipper is shaped to conform to the foot and ankle. Front closure 16 is positioned to tighten the upper around the ankle. As seen in FIG. 3, the front closure 16 is comprised of a hook and loop fastener, with the hook portion 18 being secured to the interior of a flap which overlaps loop portion 20. The slippers can be put on the foot and the front closure tightened to hold it comfortably in place.

The material of the upper is preferably material which is absorbent and can be readily washed or cleaned. Cotton terry cloth or split chamois leather are suitable for this purpose. Similarly, fabrics made of synthetic fibers are particularly advantageous when the slippers need to be cleaned.

Figure 4:
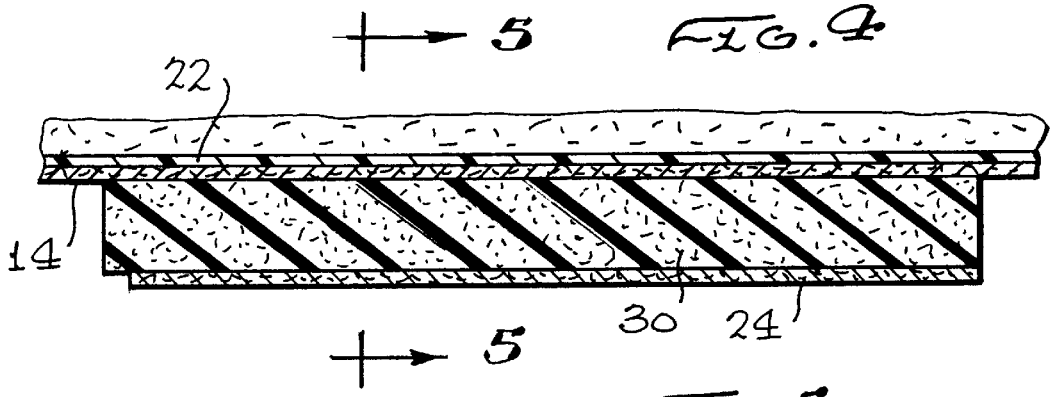
FIG. 4 is an enlarged longitudinal section taken generally along the line 4—4 of FIG. 3, with parts broken away.
Figure 5:
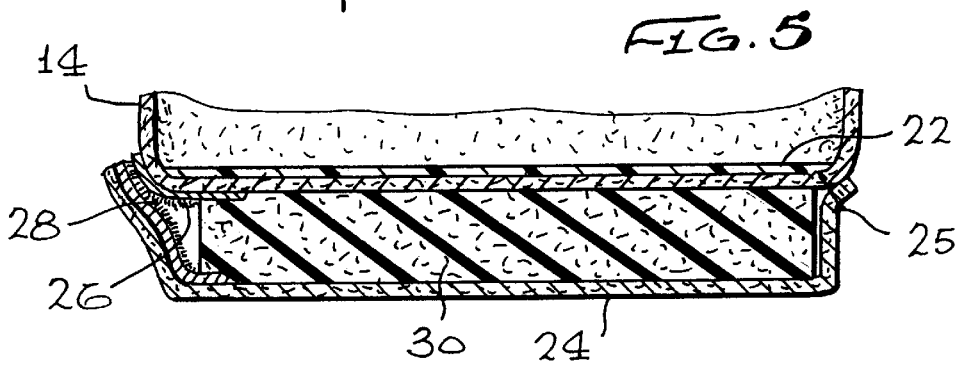
FIG. 5 is a transverse section across the slipper, taken generally along line 5—5 FIG. 4, with parts broken away.

As seen in FIGS. 3, 4 and 5 the upper 14 has a waterproof insole layer 22 therein where it passes under the foot. The waterproof insole layer 22 is preferably a sheet of synthetic polymer material. Since the upper 14 is water transmissive, the waterproof insole layer 22 serves to prevent the foot from getting excessively wet from moisture entering from below.

Figure 2:
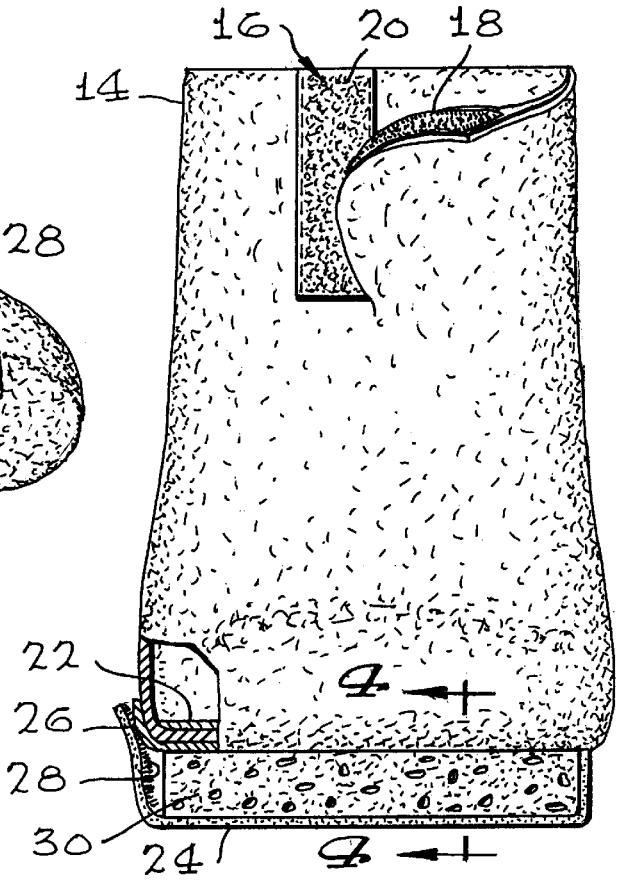
FIG. 2 is an underside isometric view of the right slipper with the securing band partly loosened and turned back to show a sponge secured under the slipper.

Band 24 (see FIGS. 2, 3, 4 and 5) is a band of water transmissive material, such as cotton terry cloth, split leather chamois or the like, and is preferably the same as the material of the upper 14. The band 24 is permanently attached as by sewing stitches 25 through the band and through the inside or left side of the upper 14 of the right slipper 10. The band is long enough in the front to back direction to extend in substantially the entire front to back length of the slipper, as seen in FIGS. 1 and 2. The right side of the band is detachably secured by a hook and loop fastener. A panel of fastener loops 26 is secured to the outer edge of the upper where it turns under to become the bottom of the shoe, as seen in FIGS. 2, 3 and 5. A panel of fastener hooks 28 is secured to the otherwise free edge of the securing band 24. This forms an openable pocket into which material can be placed.

The material 30 is an absorbent material. It may be a synthetic material sponge, or a natural sponge cut to size. It may be cloth which is folded to size to develop a substantial thickness, for example, ¾ of an inch. It may be paper towelling which is folded to size by the user or is prefolded. This absorbent material 30 is put in place and the securing band 24 is pulled around it. The attachment of the band 24 by the hook and loop fasteners 26 and 28 permits firm engagement of the absorbent material 30 in place even with variations in thickness. As seen in FIG. 5, the hook fastener panel 28 has significant width so that the securing band 24 can be pulled around the absorbent material and securing of the hook and loop fastener can be achieved even with different thicknesses of absorbent material.

Figure 6:
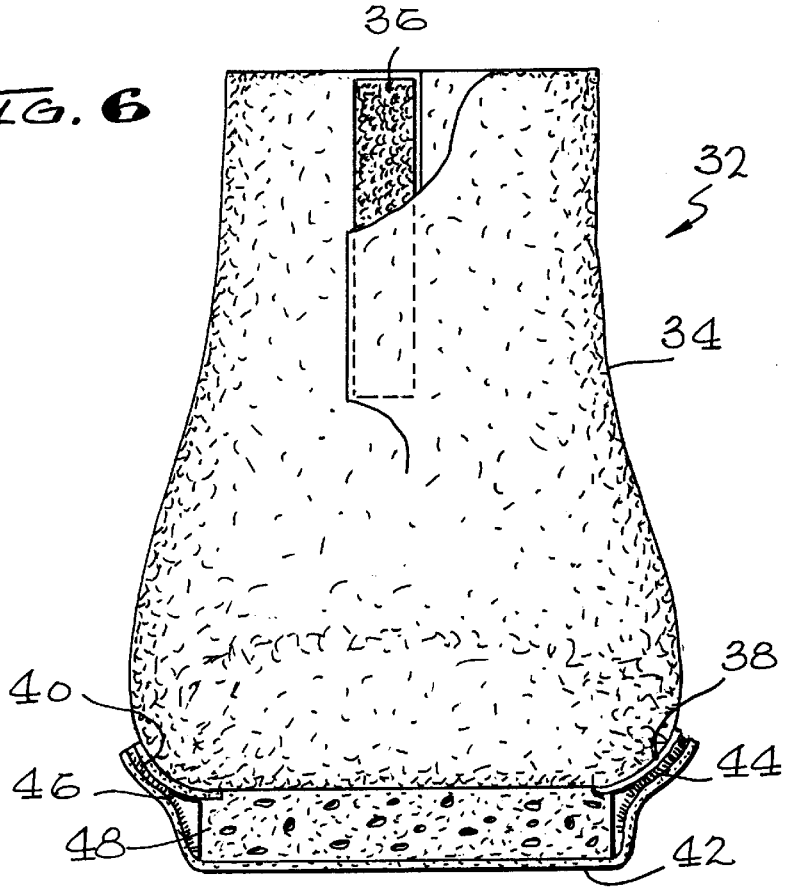
FIG. 6 is a front view, similar to FIG. 3, of a second preferred embodiment of the absorbent cleaning slippers of this invention.

The absorbent cleaning slipper 32 shown in FIG. 6 is the right slipper of a pair suitable for use on the user's feet. The view is the same as that in FIG. 3. FIG. 6 shows the upper 34 with the hook and loop fastener 36 at the front of the slipper. This permits the user to put the slipper on his foot and tighten it to his comfort. The slipper 32 with its upper 34 is shaped to be comfortably worn. At its bottom the upper has a waterproof layer (not shown), such as the layer 22. The lower portion of the slipper, adjacent its lower edges, has left and right hook fastener panels 38 and 40 attached thereto. Securing band 42 has left and right loop fastener panels 44 and 46 secured adjacent its edges. The band 42 is sufficiently wide so that absorbent material 48 can be placed under the band 42 and the left and right hook and loop fastener panels secured together. The left and right loop fastener panels are of sufficient length so that the securing band 42 can be tightened under the slipper with various thicknesses of absorbent material 48 therein. The securing band 42 is porous, such as cotton terry cloth, and it is flexible to be able to tighten around the absorbent material. The absorbent material may be a synthetic sponge, paper towels or absorbent rags.

The securing band 42 is completely removable from the upper of the slipper to permit the separate washing of the securing bands. In use, the securing band 42 is in direct contact with the floor and, thus, requires regular washing. When the upper is also terry cloth, separation for washing is not helpful. However, when the upper is split leather "chamois" material, it is desirable to separately wash the securing bands. Furthermore, the securing band 42 can be replaced and the new band used with the old slipper.

The user can use the absorbent cleaning slippers 10 and 32 in many ways. When the user is doing general kitchen and dining room work, the user may place a moistened sponge, perhaps with a small amount of soap, on the bottom of each slipper. The sponges are held in place by the securing bands. While walking around, the user is cleaning the floor 50 (see FIG. 1). The cleaning is done while the hands are free for other work. When the absorbent material 30 and 48 is only slightly damp, they can be used for sopping up spills, such as at 52, without bending and without needing to free the hands for mop-up with a rag. When working at the sink, overflows and dripping can quickly be mopped up. These uses of the slippers presume that the absorbent material is damp and perhaps slightly soapy.

If the absorbent material is dry, the user can walk on a freshly mopped wet floor surface without the consequence of leaving footprints or dirt thereon. The use of dry slippers on the damp floor quickens the drying, by picking up some of the moisture into the slippers. In drying the floor, the absorbent cleaning slippers can reach into small and tight areas, such as interior corners at the-kickboard under kitchen cabinets and hard-to-reach places such as behind the toilet in the bathroom. Thus, mopping and drying is easily achieved without bending and using the hands for sopping up spills with a rag.

The slippers are designed to be washed and, in the case of split leather, the leather can be regularly conditioned to maintain its flexibility and absorbency. In the case of the slippers 32, the securing band can be separately washed. This is advantageous because it is the securing band which comes directly into contact with the floor and which, thus, picks up most of the dirt. In the case of the slippers 32, the securing band can be separately washed for re-use. Furthermore, a plurality of separate securing bands can be employed so that they can be successively used. This permits full life out of the upper during the wear-out of a plurality of securing bands. The use of the securing band which releases along at least one side makes it easy to quickly remove the sponge or other absorbent material. In the case of a sponge, it can be rinsed and re-inserted. In the case of rags or paper towels, new materials can be placed within the securing band and the band re-attached. The use of a hook and loop fastener easily accommodates for the differences in size of different absorbent materials.

This invention has been described in its presently contemplated best embodiments and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An absorbent cleaning slipper comprising:

an upper sized to fit a person's foot, said upper having sides and terminating in an insole which defines a foot space within said upper, said insole being substantially water-impermeable;

a securing band, said securing band extending substantially the entire front to back length of said slipper, said securing band being attached to said upper on each side thereof, said securing band being sufficiently long so as to embrace absorbent material between said securing band and said insole, said securing band having releasable attachment structure on at least one side of said upper so that said securing band can be tightened around absorbent material under said insole, said releasable attachment structure of said securing band to said upper being formed of a hook and loop fastener, said securing band being made of moisture transmissive material so that said slipper can be worn and applied to a damp spot for absorbing the moisture thereof.

2. The absorbent cleaning slipper of claim 1 wherein said securing band is made of washable material.

3. An absorbent cleaning slipper comprising:

an upper having sides and sized to fit a person's foot, said upper terminating in an insole which defines a foot space within said upper, said insole being substantially water-impermeable;

a securing band, said securing band extending substantially the entire front to back length of said slipper, said securing band being attached to said upper on both sides of said upper so that said securing band can be separated and separately washed and replaced thereon, said securing band being sufficiently long so as to embrace absorbent material between said securing band and said insole, said securing band having detachable attachment structure on both sides of said upper so that said securing band can be separated and separately washed and replaced thereon and tightened around absorbent material under said insole, said detachable attachment structure of said securing band comprising hook and loop fasteners on both ends of said securing band, said securing band being made of moisture transmissive material so that said slipper can be worn and applied to a damp spot for absorbing the moisture thereof.

4. An absorbent cleaning slipper comprising:

an upper, said upper being formed of flexible material and having sides and being sized to form a foot space for a user, said upper having a front and a back and having a sole beneath the foot space in said upper;

an insole within said upper, said insole being positioned within said slipper, said insole being of substantially waterproof material;

a securing band, said securing band being sufficiently wide to reach from side to side of said slipper and engage around absorbent material below said insole, said securing band being attached to said slipper on each side thereof to define a pocket therein to receive absorbent material, said securing band being detachably attached to said slipper on at least one side thereof by hook and loop fasteners so that the pocket formed by said securing band can be opened and absorbent material can be removed and replaced therein and said securing band can be resecured to retain said absorbent material in place, said securing band being made of water transmissive material so that said slipper can be worn to remove water from the floor.

5. The absorbent cleaning slipper of claim 4 wherein said hook and loop fasteners are on at least one side of said slipper.

6. The absorbent cleaning slipper of claim 5 wherein said hook and loop fasteners are on both sides of said securing band so that said securing band can be removed, separately washed and replaced.

7. The absorbent cleaning slipper of claim 4 wherein said upper is made of split leather chamois.

8. The absorbent cleaning slipper of claim 4 wherein said securing band is made of cotton terry cloth.

9. An absorbent cleaning slipper comprising: an upper, said upper being formed of flexible material and having sides and being sized to form a foot space for a user, said upper having a front and a back and having a sole beneath the foot space in said upper;

an insole within said upper, said insole being positioned within said slipper, said insole being of substantially waterproof material;

a securing band, said securing band being sufficiently wide to reach from side to side of said slipper and engage around absorbent material below said insole, said securing band being attached to said slipper on each side thereof to define a Pocket therein to receive absorbent material, a synthetic foam sponge embraced and retained in said pocket against the sole of said slipper by said securing band, said securing band being detachably attached to said slipper on at least one side thereof so that the Pocket formed by said securing band can be opened and absorbent material can be removed and replaced therein and said securing band can be resecured to retain said absorbent material in place, said securing band being made of water transmissive material so that said slipper can be worn to remove water from the floor.

10. The absorbent cleaning slipper of claim 9 wherein said securing band is detachably attached by hook and loop fasteners.

11. The absorbent cleaning slipper of claim 10 wherein said hook and loop fasteners are on at least one side of said slipper.

12. The absorbent cleaning slipper of claim 11 wherein said hook and loop fasteners are on both sides of said securing band so that said securing band can be removed, separately washed and replaced.

* * * * *